US011078694B2

(12) United States Patent
Pettengill

(10) Patent No.: US 11,078,694 B2
(45) Date of Patent: Aug. 3, 2021

(54) MOTOR VEHICLE DOOR LOCK

(71) Applicant: Kiekert Aktiengesellschaft, Heiligenhaus (DE)

(72) Inventor: Robert S. Pettengill, Farmington, MI (US)

(73) Assignee: Kiekert AG, Heiligenhaus (DE)

( * ) Notice: Subject to any disclaimer, the term of this patent is extended or adjusted under 35 U.S.C. 154(b) by 469 days.

(21) Appl. No.: 15/618,215

(22) Filed: Jun. 9, 2017

(65) Prior Publication Data

US 2017/0356221 A1 Dec. 14, 2017

Related U.S. Application Data

(60) Provisional application No. 62/348,427, filed on Jun. 10, 2016.

(51) Int. Cl.

| | |
|---|---|
| ***E05B 85/06*** | (2014.01) |
| ***E05B 81/04*** | (2014.01) |
| ***E05B 81/90*** | (2014.01) |
| ***E05B 81/06*** | (2014.01) |
| ***E05B 77/26*** | (2014.01) |
| ***E05B 77/28*** | (2014.01) |

(52) U.S. Cl.

CPC ..... *E05B 85/06* (2013.01); *E05B 81/04* (2013.01); *E05B 77/26* (2013.01); *E05B 77/28* (2013.01); *E05B 81/06* (2013.01); *E05B 81/90* (2013.01); *Y10S 292/23* (2013.01); *Y10T 292/108* (2015.04); *Y10T 292/1047* (2015.04); *Y10T 292/1075* (2015.04); *Y10T 292/1082* (2015.04); *Y10T 292/1092* (2015.04)

(58) Field of Classification Search

CPC ..... E05B 81/06; E05B 77/26; E05B 77/28; E05B 81/90; E05B 85/06; E05B 81/04; E05B 79/10; Y10T 292/1075; Y10T 292/108; Y10T 292/1082; Y10T 292/1092; Y10T 292/1047; Y10S 292/23

See application file for complete search history.

(56) References Cited

U.S. PATENT DOCUMENTS 4,664,430 A * 5/1987 Bernard ..... E05B 81/20 292/201
5,078,436 A * 1/1992 Kleefeldt ..... E05B 81/06 292/201

(Continued)

FOREIGN PATENT DOCUMENTS

DE 41 31 891 A1 4/1993
DE 100 14 321 A1 9/2001

(Continued)

*Primary Examiner* — Kristina R Fulton
*Assistant Examiner* — Faria F Ahmad
(74) *Attorney, Agent, or Firm* — Renner, Otto, Boisselle & Sklar, LLP

(57) ABSTRACT

The object of the invention is a motor vehicle door lock that is equipped with a lock housing (4), also with a lock cylinder nut (3) supported in the lock housing (4), and at least one locking element (9) that can be acted upon by the lock cylinder nut (3) via a positioning element (8). According to the invention, the lock cylinder nut (3) has a connected eccentric element (6). Said eccentric element (6) engages in an eccentric mounting (7) of positioning element (8) in order to displace it.

17 Claims, 3 Drawing Sheets

(56) References Cited

Figure 1:
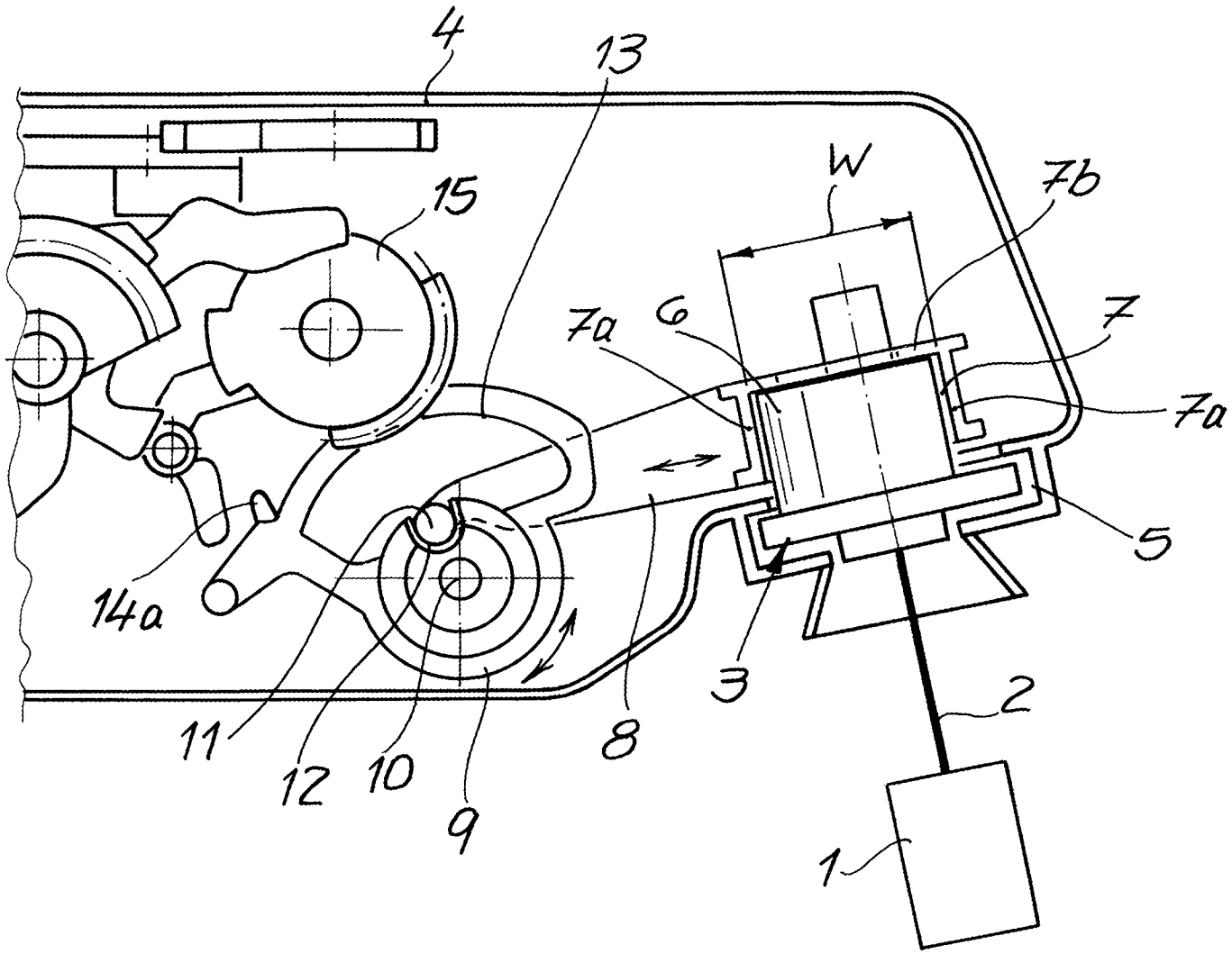

U.S. PATENT DOCUMENTS 5,149,156 A * 9/1992 Kleefeldt ..... E05B 81/25 292/201
5,309,745 A 5/1994 Ursel et al.
5,419,597 A * 5/1995 Brackmann ..... E05B 81/06 292/201
5,667,260 A * 9/1997 Weyerstall ..... E05B 13/005 292/201
5,852,943 A * 12/1998 Dutka ..... B60S 1/18 70/237
5,997,055 A * 12/1999 Strathmann ..... E05B 81/06 292/199
6,065,316 A * 5/2000 Sato ..... E05B 81/06 292/201
6,338,508 B1 * 1/2002 Kleefeldt ..... E05B 81/06 292/201
6,648,379 B1 * 11/2003 Kordowski ..... E05B 81/14 292/201
6,669,247 B2 * 12/2003 Swan ..... E05B 81/14 292/201
6,705,649 B1 * 3/2004 Reddmann ..... E05B 81/06 292/201
6,964,438 B2 * 11/2005 Koike ..... E05B 81/20 292/201
7,000,956 B2 * 2/2006 Fisher
10,309,130 B2 * 6/2019 Schiffer et al.
10,400,488 B2 * 9/2019 Dufay ..... E05C 3/24
2003/0094818 A1 * 5/2003 Tomaszewski ..... E05B 77/26 292/195
2004/0129040 A1 * 7/2004 Mathofer ..... E05B 83/36 70/208
2005/0082842 A1 * 4/2005 Warmke ..... E05B 77/28 292/216
2012/0119520 A1 * 5/2012 Akizuki ..... E05B 83/36 292/196
2012/0139269 A1 * 6/2012 Kouzuma ..... E05B 79/20 292/195
2015/0240534 A1 * 8/2015 Kuriyama ..... E05B 81/14 292/201
2019/0226246 A1 * 7/2019 Schiffer ..... E05B 81/50

FOREIGN PATENT DOCUMENTS

DE 10 2004 027 381 A1 12/2005
GB 831723 A * 3/1960
GB 2182706 A * 5/1987 ..... E05B 13/106

* cited by examiner

MOTOR VEHICLE DOOR LOCK

This application claims priority to U.S. Provisional Patent Application No. 62/348,427 filed Jun. 10, 2016, which is hereby incorporated herein by reference.

DESCRIPTION

The invention relates to a motor vehicle door lock having a lock housing, also with a lock cylinder nut supported in the lock housing, and having at least one locking element that can be acted upon by a positioning element.

A motor vehicle door lock constructed as above is described in DE 100 14 321 A1. In that case, the lock cylinder nut supported in the lock housing operates on an actuating lever that is coupled to a locking device. The locking device may be moved between an unlocked position and a locked position either by the lock cylinder nut or by an electric actuator.

Also in this context a distinction is made between a single locked position and a double locked position. The single locked position corresponds to an action in which a locking lever moves to a decoupled position to break a mechanical connection from a door opener as far as the lock latch or a locking mechanism. For the double locked position, the locking lever in question may be blocked in the decoupled position as well. This state is also referred to in practice and in the literature as the "double lock" position.

The lock cylinder nut in the lock housing is connected mechanically to a lock cylinder, which is typically fitted in an associated motor vehicle door. This may be assured with the aid of a corresponding adjusting rod that transfers rotary movements of the lock cylinder to the lock cylinder nut, which in turn acts on the positioning element.

In order to convert the rotary motion of the lock cylinder nut into a linear motion of the actuating lever, one end of the actuating lever of DE 100 14 321 A1 is provided with a toothing system, which engages with a matching toothing system provided on the lock cylinder nut. This interaction between the two toothing systems is associated with disadvantages, not only because of the possibility that it may become dirty, but also because it is susceptible to wear, and is consequently unsuitable for reliable function in the long term.

Independently of the motor vehicle door lock described in the preceding text, a locking device for a motor vehicle door lock in which a coupling element extends out of the lock housing so that it is able to be connected directly to a transmission element was also disclosed in DE 10 2004 027 381 A1. The transmission element is impinged upon by an actuating lever.

Additionally, DE 41 31 891 A1 describes a blocking device for doors of a motor vehicle, in which a lock cylinder mounted in the vehicle door is operable from the outside with the aid of a key. The lock cylinder is connected to a deadbolt that can be rotated mechanically with the key if the engine is unable to run.

The technical problem underlying the invention is to further develop a motor vehicle door lock of the construction described in the introduction in such manner that functionally reliable operation is guaranteed for the long term under all conditions.

In order to solve this technical problem it is provided within the scope of the invention that the lock cylinder nut of a species-related motor vehicle door lock has a connected eccentric element that engages in an eccentric mounting in the positioning element for the purpose of displacing it.

Thus, in contrast to the prior art according to DE 100 14 321 A1, the solution according to the invention explicitly makes no use of a toothing system as a means of mechanical connection between the lock cylinder nut and the positioning element. Instead, according to the invention the eccentric element connected to the lock cylinder nut and the eccentric mounting are permanently coupled with one another in a sliding manner. The clear span of the eccentric mounting is designed to match a maximum deflection created by the eccentric element. Consequently, however, there are positions that the eccentric element can take up in which it can not in be contact with either or both of the walls of the eccentric mounting concerned, but is disconnected from them.

This makes it possible for the locking element to be impinged upon by the positioning element, without the aid of the lock cylinder nut. The locking element may also be moved to the desired function position by means of a motorised drive, instead.

In fact, the locking element in question is typically able to assume at least two function positions, "locked" and "unlocked". Both function positions can be preset mechanically via the lock cylinder, the lock cylinder nut, the positioning element and finally the locking element. In addition, however, displacement by electric means with the aid of the motorised drive is also possible. For this purpose, the motorised drive may engage in a mounting in the locking element. In this way, it is possible for the motorised drive to act directly upon the locking element to move it to either of the function positions, "locked" and "unlocked".

The eccentric element typically takes up a neutral position after every mechanical (or electric) positioning movement (with the aid of the lock cylinder). In this neutral position, the eccentric element is free from the eccentric mounting that surrounds it and also free from the motorised drive. Thus with the eccentric element in the respective neutral position the locking element can be moved to either of the function positions described with the aid of the motorised drive. This typically means that in this operation the positioning element is displaced or could be displaced, but the eccentric element remains in its function position, the neutral position. This in turn means that the electric or motorised drive only has to generate small forces and may therefore be of compact, inexpensive design. Starting with the neutral position the motorised drive can therefore lock and unlock the said vehicle door lock.

A further consequence is that the functional reliability is considerably greater than with the prior art. The same applies for the maximum achievable service life. Because in contrast to the prior art according to DE 100 14 321 A1, the motorised drive has not necessarily to displace the positioning element so that it takes up one of the two function positions. This is possible without the application of great force, while unintended gearing engagement, misalignments and the like are explicitly avoided because such elements are explicitly not used according to the invention.

Besides the conceivable motorised displacement of the locking element, a particularly high degree of functional reliability is guaranteed if the locking element is impinged upon manually. Because the positioning element can be displaced easily with the aid of the eccentric element connected to the lock cylinder nut, typically in linear manner. Such a positioning movement is not hindered by any possible soiling or even wear between the eccentric element and the eccentric mounting. Moreover, the lock cylinder nut and/or the positioning element may be manufactured from plastic, thereby enabling particularly low-friction operation, and at the same time the weight of a motor vehicle door lock equipped in such manner within the scope of the invention is reduced compared with the solid designs of the prior art as described in DE 100 14 321 A1.

As a result, a novel motor vehicle door lock is provided in which it is possible for the said door lock to be moved to its function positions both manually and by motorised means. In this context, the actuating forces involved are low in both cases. This renders operation more convenient and also enables the implementation of a particularly compact, lightweight electric motor as a component of the motorised drive. At the same time, functional reliability is assured for the long term, because the use of engaging mechanical elements such as toothing systems is explicitly avoided. Instead, the invention makes use of surfaces that slide past each other over large areas, in the case of the eccentric element and the eccentric mounting that accommodates the element. In this way, not only is wear reduced, but functional failures can also be prevented de facto. These represent the essential advantages of the invention.

According to an advantageous variation, the eccentric element is conformed on the lock cylinder nut. In fact, the eccentric element and the lock cylinder nut may define an integral component, which may be produced for example as a plastic injection moulded part. It has further proven generally advantageous if the eccentric element and the lock cylinder nut in this context share a common axis of rotation.

As a rule, the eccentric element has the form of a cam. Additionally, the positioning element is most often a lock slider that is capable of linear movement. One end of the positioning element, or the linearly movable lock slider, generally controls the eccentric mounting described previously, in which the eccentric element connected to the lock cylinder nut engages. An actuating pin is provided on the other end of the positioning element.

The actuating pin engages in a pin receiving hole in the locking element. This enables the positioning element to act on the locking element via the actuating pin and cause it to move to either of the two function positions "locked" and "unlocked".

Normally, the locking element is mounted so as to be rotatable in the lock housing. Since the pin receiving hole is typically provided with a radial offset relative to an associated axis of rotation of the locking element in the lock housing, the locking element is rotatable at will with the aid of the actuating pin connected to the positioning element. To this end, the linear or adjusting movement of the positioning element is converted into a corresponding rotating movement of the locking element.

In this context, one end position of the rotating movement corresponds for example to the "locked" function position, and the other end position of the rotating movement of the locking element corresponds to the "unlocked" function position. As a rule, the neutral position of the locking element is located between these two end positions. The neutral position of the locking element corresponds to the neutral position of the eccentric element and consequently of the eccentric mounting and the positioning element as well.

The positioning element is generally designed such that it engages below the locking element. This causes the actuating pin provided at the end of the positioning element to be inserted in the pin mounting hole on the locking element from below. This design of the positioning element or lock slider also enables it to be moved back and forth along the bottom of the lock housing. Consequently, the lock housing functions as a guide for the positioning element or the linearly movable lock slider.

In this way, the area above the locking element is free from elements for mechanically displacing the locking element. Thus, the additional and optional motorised drive may be installed in this area above the locking element, and is thus able to interact directly with the mounting in the locking element, as described previously.

The eccentric mounting as such typically has a U-shaped cross-section. In fact, each wall of the eccentric mounting is high. In this configuration, the two legs of the "U" shaped eccentric mounting function as limit and sliding surfaces for the eccentric element or the cam that is advantageously provided here. The base of the U-shape of the eccentric mounting defines a bearing flange for the eccentric element or the integral component consisting of the lock cylinder nut and the eccentric element conformed therewith. This provides the structural unit consisting of the lock cylinder nut and the eccentric element with flawless axial guidance between an edge of the lock housing for supporting the lock cylinder nut on the one hand an the U-shaped base of the eccentric mounting on the other, wherein the base functions as a bearing flange for the cam or the component concerned.

Figure 2:
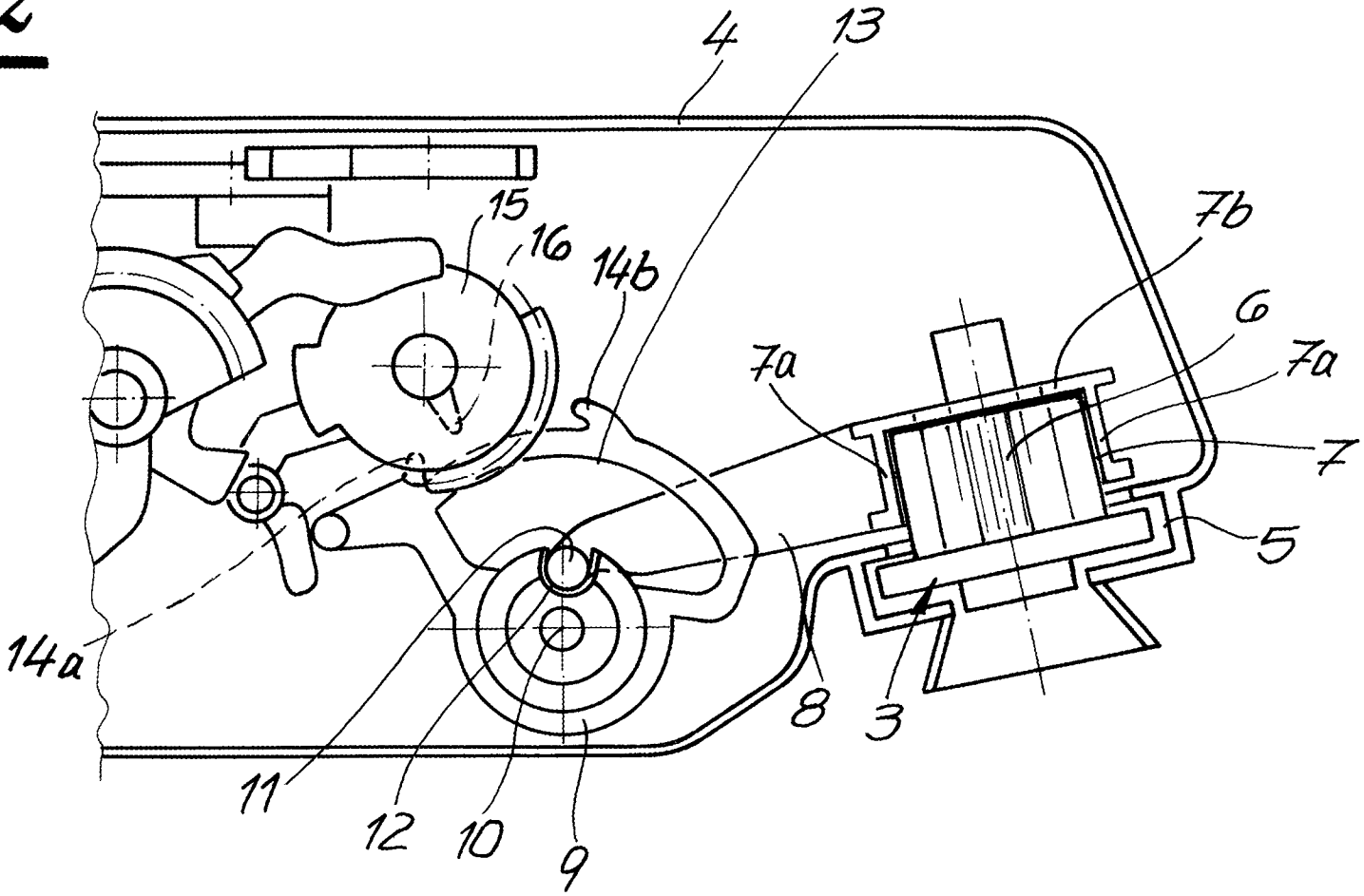
Figure 3:
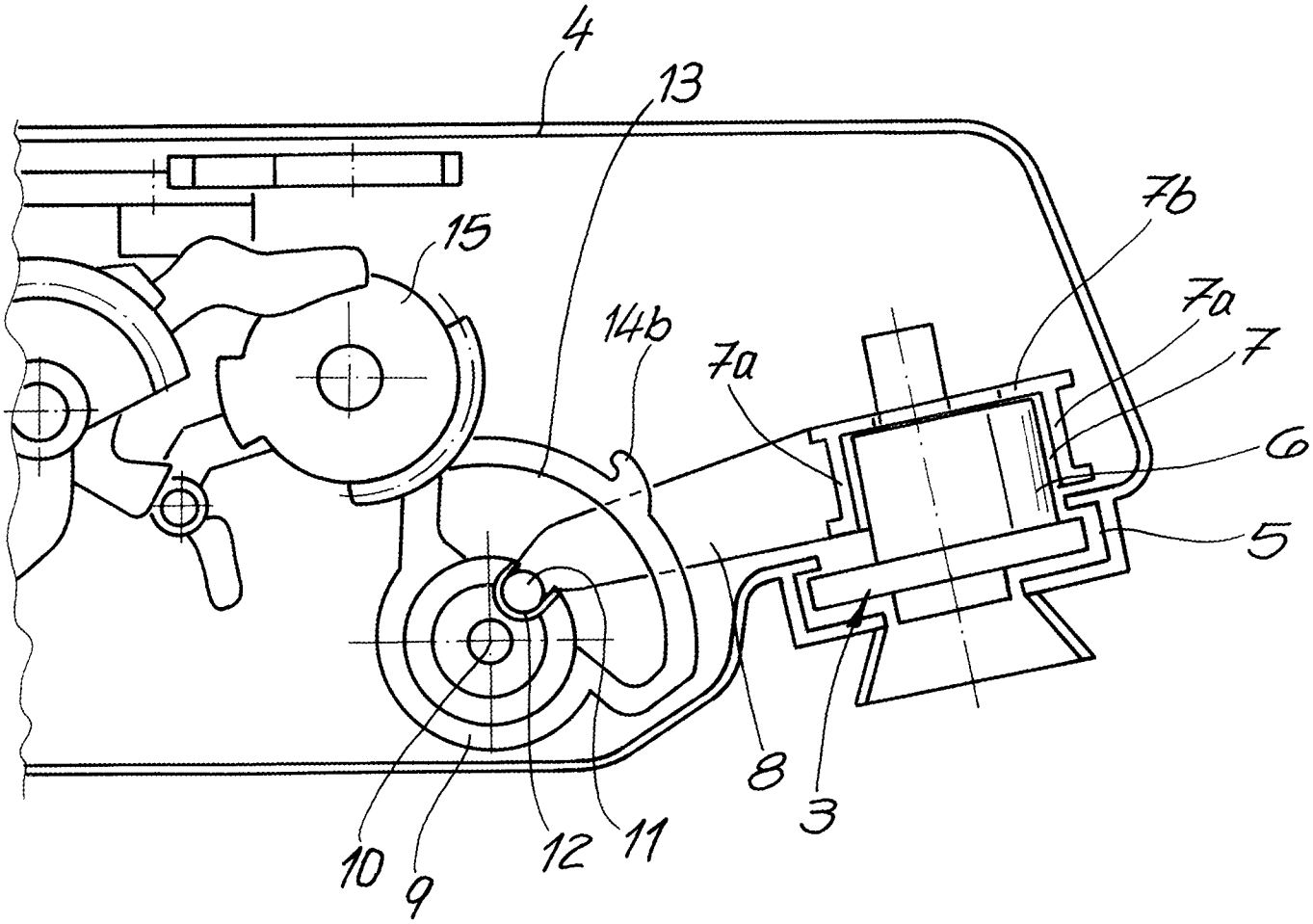

In the following, the invention will be explained in greater detail with reference to a drawing representing an exemplary embodiment of the invention. In the drawing:

FIG. 1 is a perspective view of the motor vehicle door lock according to the invention in the "locked" function position, FIG. 2 shows the motor vehicle door lock of FIG. 1 in the "neutral" position, FIG. 3 shows the object of FIGS. 1 and 2 in the a perspective view of the motor vehicle door lock in the "unlocked" function position.

The figures represent a motor vehicle door lock. The motor vehicle door lock is typically located on the inside of a motor vehicle door—not shown here. The motor vehicle door is typically a motor vehicle side door and particularly a driver's door or a front passenger's door, and is equipped with a lock cylinder 1 for unlocking/locking with the aid of mechanical key, for example.

Lock cylinder 1, which is only shown in outline in FIG. 1, is coupled mechanically with a lock cylinder nut 3 via a mechanical connecting device 2. In the example shown, mechanical connecting device 2 is a rod or adjusting rod that transfers rotary movements of lock cylinder 1 to lock cylinder nut 3.

Lock cylinder nut 3 is supported rotatably in a lock housing 4. For this purpose, lock cylinder nut 3 engages in a corresponding rotary bearing mounting 5 in lock housing 4. According to the invention, lock cylinder nut 3 is furnished with a connected eccentric element 6. In the embodiment shown, eccentric element 6 is a cam 6 that is conformed with lock cylinder nut 3. This means that in the embodiment shown cam 6 and lock cylinder nut 3 form an integral component 3, 6. Integral component 3, 6 may have the form of a plastic injection moulded part.

The eccentric element or cam 6 is held in place in an eccentric mounting 7. Eccentric mounting 7 is part of positioning element 8. Lock cylinder nut 3 acts on a locking element 9 via positioning element 8. Locking element 9 may be a central locking element. Locking element 9 is mounted rotatably about an axis or axis of rotation 10 in lock housing 4.

In order to displace positioning element 8, lock cylinder nut 3 and the eccentric element 6 connected thereto engages in eccentric mounting 7 of positioning element 8. In the present arrangement, positioning element 8 is designed as a lock slider 8 that is capable of linear movement. The linear movements of lock slider 8 are indicated by a double-headed arrow in FIG. 1. These enable locking element 9 to move to the "locked" function position shown in FIG. 1, as well as the "unlocked" function position shown in FIG. 3. Finally, the "neutral position" of locking element 9 is shown in FIG. 2.

Eccentric mounting 7 is located on one end of the positioning element or linearly movable lock slider 8. An actuating pin 11 is provided on the other end. Actuating pin 11 engages in a pin receiving hole 12 in locking element 9. It will be seen that pin receiving hole 12 in locking element 9 for accommodating actuating pin 11 is arranged with a radial offset relative to axis of rotation 10 of locking element 9. Consequently, the linear adjustment movement of positioning element or lock slider 8 indicated in FIG. 1 by a double-headed arrow causes corresponding rotating movements of locking element 9 relative to axis of rotation 10. This is also indicated in FIG. 1 by a double-headed arrow.

As is also shown, positioning element 8 clasps locking element 9 from below. Consequently, actuating pin 11 protrudes into pin receiving hole 12 of locking element 9 from below. In this way, the positioning element or lock slider 8 is guided along the bottom of lock housing 4. Lock housing 4 serves as an additional guide for positioning element or lock slider 8. Positioning element or lock slider 8 also moves in an intermediate space between the bottom of lock housing 4 and an underside of locking element 9.

This means that the upper side of locking element 9 is free from any components or elements of the manual locking device described previously. Thus, a motorised drive—not shown here—may be installed above locking element 9, so that motorised displacement of locking element 9 is then possible, and explicitly permitted, independently of the manual displacement described earlier. For the motorised displacement of locking element 9, an electric motor can engage either directly, or typically via intermediate elements such as an eccentric element, in a mounting 13 in locking element 9. Mounting 13 may be an eccentric mounting, which interacts with an eccentric element driven by the motorised drive to rotate locking element 9.

The design of the motorised drive and eccentric element and the associated mounting 13 or eccentric mounting 13 in locking element 9 may be similar or comparable, as described in patent DE 199 433 483 A1, which is held by the applicant. At all events, locking element 9 respective the motor vehicle door lock as a whole may also be moved to the "locked" function position shown in FIG. 1 and the "unlocked" function position shown in FIG. 3 with the aid of the motorised drive—not shown—regardless of any actuation of lock cylinder 1.

Eccentric mounting 7 has a U-shaped cross-section. In fact, eccentric mounting 7 has two opposing legs 7*a* forming a "U" shape. The two U-shaped legs 7*a* each define limit and sliding surfaces for the eccentric element or cam 6. Also, it is configured such that the two U-shaped legs 7*a* face each other and are at a distance from each other, defining a clear span W of eccentric mounting 7 that is adapted to the maximum extension of eccentric element 6 inside eccentric mounting 7. This maximum extension of eccentric element 6 inside eccentric mounting 7 is assumed either in the "locked" position according to FIG. 1 or in the "unlocked" position according to FIG. 3.

On the other hand, FIG. 2 corresponds to the "neutral position". In this neutral position, eccentric element 6 is still in contact with both U-shaped legs 7*a* of eccentric mounting 7. This enables locking element 9 to move from the "neutral position" shown in FIG. 2 either to the "locked" function position of FIG. 1, or to the "unlocked" function position of FIG. 3, for example with the aid of the motorised drive, which is not shown. Then, locking element 9 is rotated about axis of rotation 10 by a corresponding rotating motion, and positioning element 8 follows the corresponding rotating motion. However, eccentric element or cam 6 remains in its "neutral position" as shown in FIG. 2.

A motorised drive 15, 16 depicted in the drawings interacts with two fingers 14*a*, 14*b* of the locking element 9. These two fingers 14*a*, 14*b* define a clearance which does not interact with a projection 16 of the motorised drive 15, 16. In the "neutral position" of the locking element 9 shown in FIG. 2 the two fingers 14*a*, 14*b* are free from the projection 16 which projects from the bottom of a driving disk 15 of the motorised drive 15, 16. Rotations of the driving disk 15 and therefore of the projection 16 have no effect in the locking element 9. The motorised drive 15, 16 can freely rotate in the locked or unlocked position of the motor vehicle door lock.

Starting from the "neutral position" of FIG. 2 locking element 9 performs a counterclockwise rotating movement to the transition to the "locked" position of FIG. 1. On the other hand, in order to reach the "unlocked" position of FIG. 3—starting from the neutral position shown in FIG. 2—locking element 9 is rotated clockwise about its axis of rotation 10. As was explained previously, this is effected by the lock cylinder nut 3 and cam 6 attached thereto which are rotated correspondingly with the aid of lock cylinder 1.

Besides the two "U" legs 7*a*, the U-shaped eccentric mounting 7 also has a U-base 7*b*. U-base 7*b* serves to provide additional support for cam 6, or assembly 3, 6 consisting of lock cylinder nut 3 and eccentric element 6. This means that U-base 7*b* functions as a bearing flange as well as pivot bearing mounting 5 in lock housing 4 for lock cylinder nut 3. Consequently, assembly 3, 6 consisting of lock cylinder nut 3 and eccentric element or cam 6 has a double bearing, in both pivot bearing mounting 5 and in U-base 7*b* of eccentric mounting 7. This means that the assembly 3, 6 in question is also secured axially.

The mode of operation is as follows. The "locked" state of the motor vehicle door lock is shown in FIG. 1. In this function position, eccentric element or cam 6 in eccentric mounting 7 assumes it left end position. At the same time, this causes locking element 9 to be moved to its first outermost rotating position, which corresponds to the "locked" state. In this function state, locking element 9 ensures that an actuating lever chain starting at an interior door handle or exterior door handle extending as far as a ratchet—also not shown—is interrupted, so that actions on said handles involving the ratchet are not completed. After it assumes the "locked" position shown in FIG. 1, lock cylinder and therewith also lock cylinder nut 3 is moved to the "neutral position" corresponding to that shown in FIG. 2. The motor vehicle door lock is in the "single lock" position.

If lock cylinder 1 is actuated again toward the "locked position", eccentric element 6 moves to the position shown in FIG. 1 and stays in this position. The consequence of this is that locking element 9 is blocked. For this purpose, the function position corresponds to the "double lock" function position, as was described in the introduction with reference to the prior art according to DE 100 14 321 A1.

If lock cylinder nut 3, and therewith also the attached eccentric element or cam 6, is in the "neutral position" shown in FIG. 2, locking element 9 can subsequently be rotated about its axis 10, by motorised means, for example (and of course manually as well via lock cylinder 1). It is then possible for it to take up both the "locked" position of FIG. 1 and the "unlocked" position of FIG. 3. All that is needed is that the motorised drive—not shown—and its eccentric element engage in the corresponding mounting 13 of locking element 9, ensuring that it rotates about axis of rotation 10, either counterclockwise toward the "locked" position of FIG. 1 or clockwise toward the "unlocked" position of FIG. 3. According to the example shown in the drawings the locking element 9 does not move in the "neutral position" of FIG. 2, because the motorised drive 15, 16 can freely rotate without interaction with the locking element 9.

For the transition from the "neutral position" according to FIG. 2 to the "unlocked" position of FIG. 3, of course the operation may also be carried out such that lock cylinder 1 serves to rotate cylinder lock nut 3 clockwise from the "neutral position" of FIG. 2 until the "unlocked" function position of FIG. 3 is reached. Due to the interaction between cam 6 and one or both of the two "U" legs 7*a* of eccentric mounting 7, the effect of this rotary movement is to rotate locking element 9 clockwise about its axis of rotation 10. In the "unlocked position" of FIG. 3, locking element 9 ensures that the actuating lever chain that was interrupted in the "locked position" is restored again.

As a consequence of this, applying a force to the interior or exterior door handle means that the ratchet may be actuated and a desired opening effected. The associated motor vehicle door may then be opened.

The invention claimed is:

1. A motor vehicle door lock having a lock housing, also with a lock cylinder nut supported in the lock housing, and having at least one locking element that can be acted upon by the lock cylinder nut via a positioning element, wherein the lock cylinder nut has a connected eccentric element that engages in an eccentric mounting of the positioning element in order to displace the positioning element, wherein the lock cylinder nut is rotatable about an axis of rotation, and the eccentric element has an eccentric shape whereby the eccentric element has eccentric rotational movement relative to the axis of rotation, wherein the eccentric element moves to a neutral position of during movement of the positioning element.

2. The motor vehicle door lock according to claim 1, wherein the eccentric element is conformed on the lock cylinder nut.

3. The motor vehicle door lock according to claim 1, wherein the eccentric element is a cam.

4. The motor vehicle door lock according to claim 1, wherein the positioning element is a linearly movable lock slider.

5. The motor vehicle door lock according to claim 1, wherein the positioning element has the eccentric mounting at one end thereof and an actuating pin at the other end.

6. The motor vehicle door lock according to claim 5, wherein the positioning element and the actuating pin thereof engages in a pin receiving hole of the locking element.

7. The motor vehicle door lock according to claim 6, wherein the pin receiving hole has a radial offset relative to an axis of rotation of the locking element in the locking element.

8. The motor vehicle door lock according to claim 1, wherein the positioning element clasps below the locking element.

9. The motor vehicle door lock according to claim 1, wherein the eccentric mounting has a U-shaped cross section.

10. A motor vehicle door lock having a lock housing, also with a lock cylinder nut supported in the lock housing, and having at least one locking element that can be acted upon by the lock cylinder nut via a positioning element, wherein the lock cylinder nut has a connected eccentric element that engages in an eccentric mounting of the positioning element in order to displace the positioning element, wherein the lock cylinder nut is rotatable about an axis of rotation, and the eccentric element has an eccentric shape whereby the eccentric element has eccentric rotational movement relative to the axis of rotation, wherein the eccentric mounting has a U-shaped cross section.

11. The motor vehicle door lock according to claim 10, wherein the eccentric element is conformed on the lock cylinder nut.

12. The motor vehicle door lock according to claim 10, wherein the eccentric element is a cam.

13. The motor vehicle door lock according to claim 10, wherein the positioning element is a linearly movable lock slider.

14. The motor vehicle door lock according to claim 10, wherein the positioning element has the eccentric mounting at one end thereof and an actuating pin at the other end.

15. A motor vehicle door lock having a lock housing, also with a lock cylinder nut supported in the lock housing, and having at least one locking element that can be acted upon by the lock cylinder nut via a positioning element, wherein the lock cylinder nut has a connected eccentric element that engages in an eccentric mounting of the positioning element in order to displace the positioning element, wherein the lock cylinder nut is rotatable about an axis of rotation, and the eccentric element has an eccentric shape whereby the eccentric element has eccentric rotational movement relative to the axis of rotation, wherein the positioning element has the eccentric mounting at one end thereof and an actuating pin at the other end.

16. The motor vehicle door lock according to claim 15, wherein the positioning element and the actuating pin thereof engages in a pin receiving hole of the locking element.

17. The motor vehicle door lock according to claim 16, wherein the pin receiving hole has a radial offset relative to an axis of rotation of the locking element in the locking element.

* * * * *